United States Patent [19]

Soble

[11] 4,125,975

[45] Nov. 21, 1978

[54] FOUNDATION ON GRADE ARRANGEMENT FOR MANUFACTURED STRUCTURES AND METHOD OF INSTALLATION

[76] Inventor: Bernard D. Soble, 19151 Berkley, Detroit, Mich. 48221

[21] Appl. No.: 768,634

[22] Filed: Feb. 14, 1977

Related U.S. Application Data

[63] Continuation-in-part of Ser. No. 556,969, Mar. 10, 1975, Pat. No. 4,007,568.

[51] Int. Cl.[2] ..... E04D 15/00

[52] U.S. Cl. ..... 52/126; 52/297; 52/741; 52/DIG. 11

[58] Field of Search ..... 52/294, 297, 169.9, 52/166, 165, 122, 126, DIG. 11, 143, 298, 357, 23, 299, 741; 248/354 H, 354 P, 357; 254/DIG. 4

[56] References Cited

U.S. PATENT DOCUMENTS

| | | | |
|---|---|---|---|
| 3,282,001 | 11/1966 | Bigalow | 52/298 X |
| 3,302,342 | 2/1967 | Castleberry | 52/122 X |
| 3,380,205 | 4/1968 | Ratchford | 52/126 |
| 3,606,232 | 9/1971 | Young | 248/357 |
| 3,664,082 | 5/1972 | Zintel | 52/DIG. 11 |
| 3,830,024 | 8/1974 | Warnke | 52/DIG. 11 |
| 3,831,329 | 8/1974 | Lear | 52/126 |

*Primary Examiner*—Price C. Faw, Jr.
*Assistant Examiner*—Carl D. Friedman
*Attorney, Agent, or Firm*—Krass & Young

[57] ABSTRACT

An arrangement is described for providing a foundation on grade support for manufactured housing such as mobile homes which provides adequate support to resist overturning wind forces, as well as to prevent vertical or lateral shifting of the mobile home, due to earth movements resulting from mud or freeze-thaw induced shifting of the supporting soil. The foundation arrangement includes a plurality of telescoping stanchions which are adapted to be raised in order to be connected to the underframe and lowered to a final position.

5 Claims, 22 Drawing Figures

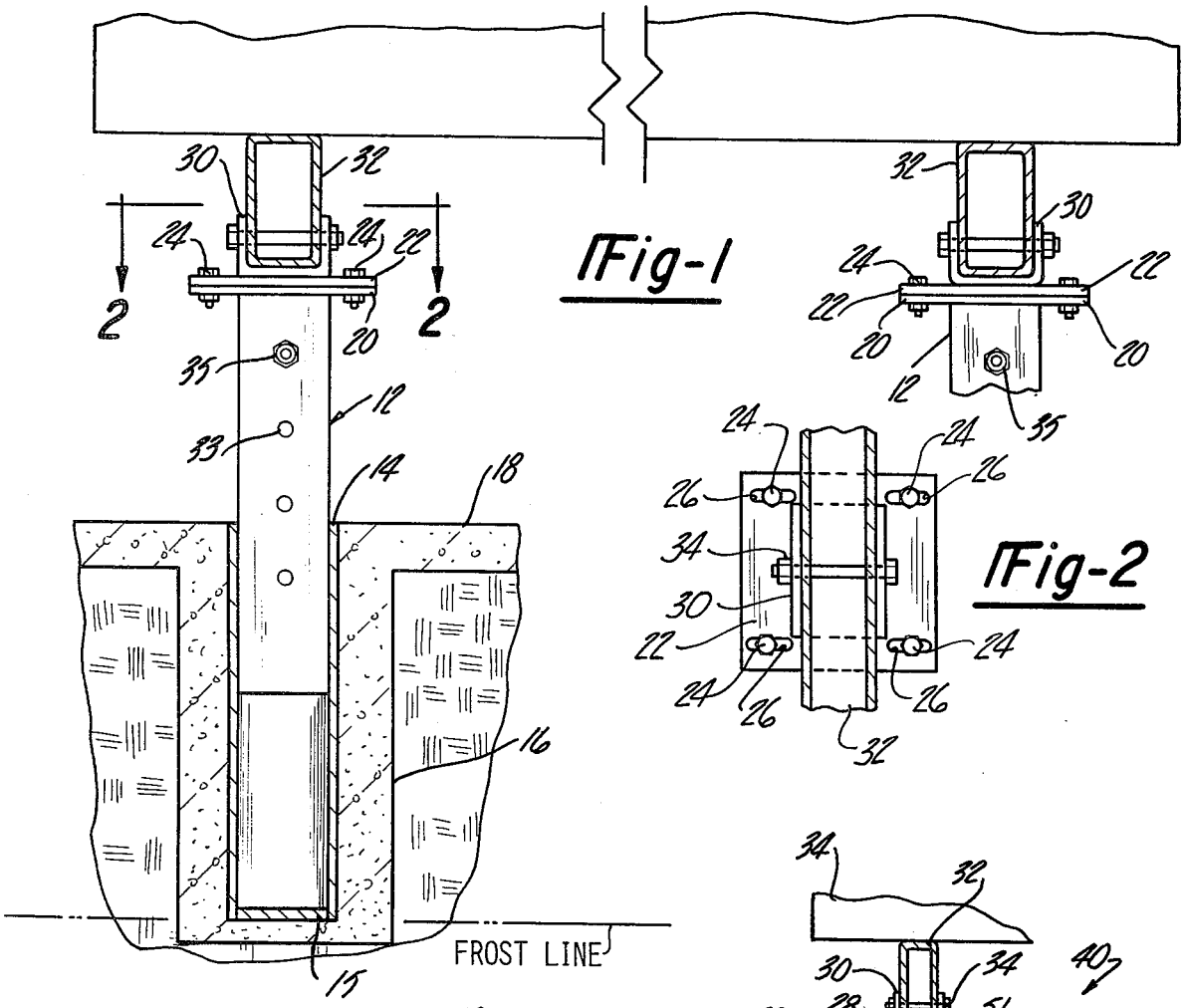
Fig-1
Fig-2
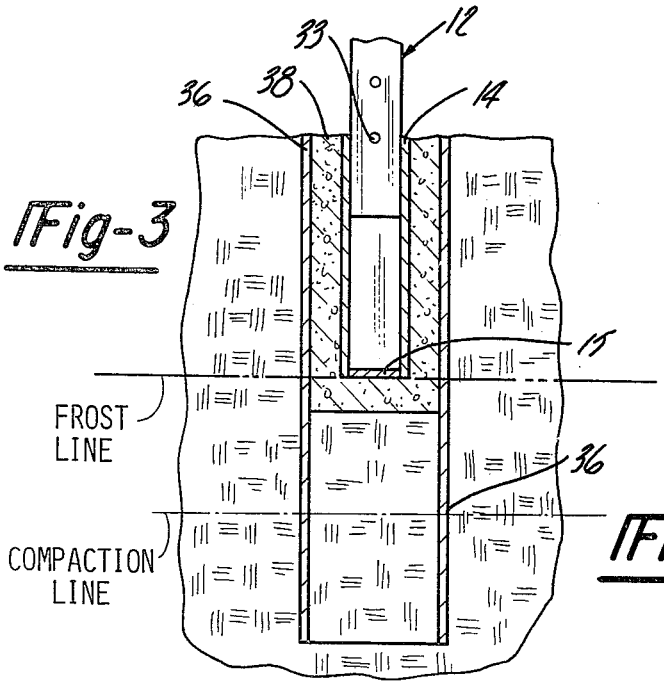
Fig-3
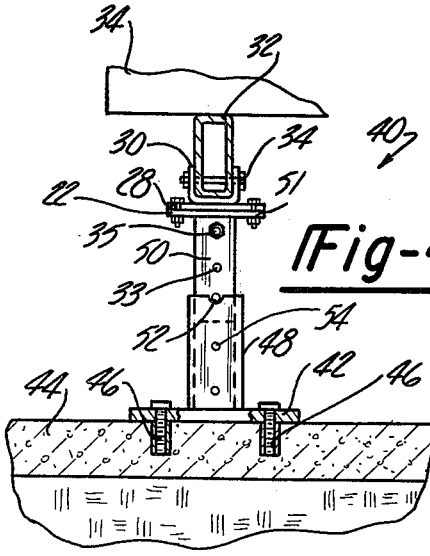
Fig-4
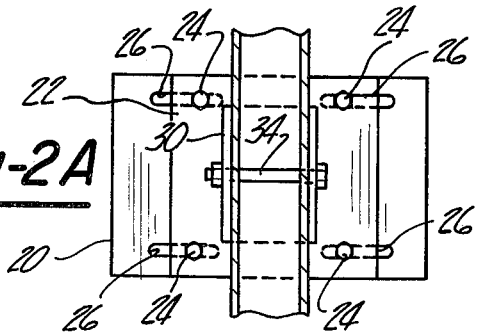
Fig-2A

FOUNDATION ON GRADE ARRANGEMENT FOR MANUFACTURED STRUCTURES AND METHOD OF INSTALLATION

CROSS REFERENCE TO RELATED APPLICATIONS

This application is a continuation-in-part of Ser. No. 556,969 filed Mar. 10, 1975 now U.S. Pat. No. 4,007,568.

BACKGROUND OF THE INVENTION

1. Field of the Invention

This invention concerns foundations, and more particularly, foundations which are particularly adapted to provide support for manufactured structures, such as mobile homes, and also concerns methods of installing such structures on foundations.

2. Description of the Prior Art

The evolution of manufactured or factory-built housing, from temporary buildings such as mobile homes moved relatively often from site to site into an alternate form of permanent construction has contributed in no small way to the inefficiencies of support designs for such structures. The original approach when such mobile homes were truly "mobile", was for the mobile home to merely be placed on blocks, such as loose piles or concrete blocks, by jacking up the mobile home structure and lowering it onto the blocks. Since overturning forces applied by high winds must be resisted, tie-downs of various types are commonly employed. As a semi-permanent or permanent installation, this arrangement has numerous disadvantages: the tie-downs, makeshift in nature, do not provide adequate resistance to the overturning forces of the wind, and sometimes create structural damage by the resulting imposition of wind loads at the points of connection to the mobile home. In addition, the ground clearance required for installation of such tie-downs generally results in a high ground clearance increasing the area presented to the wind and its tendency to overturn, and which for aesthetic reasons is objectionable. In addition, it requires the use of extensive skirting paneling and stairways, etc. which also increases the cost of installing such units.

Furthermore, this support arrangement does not provide adequate resistance to vertical and lateral movements of the soil, occuring as a result of mud, frost, thawing, etc., such that the mobile home would not be securely positioned at level.

These deficiencies have resulted in efforts to provide a more secure support arrangement for such structures, but none of these arrangements has resulted in a foundation which is entirely satisfactory in all respects.

U.S. Pat. No. 3,664,082 discloses a foundation arrangement in which there is provided a concrete slab in which are embedded a plurality of piers which carry mounting studs which are used to bolt down the I-beam underframe of the mobile home to the pier. This approach, however, presents considerable difficulties in installation of the mobile home, since the bolting of the support must be carried out when the mobile home is lowered on the pad with less than minimal working room for the workers to perform their tasks. Indeed, the appraoch shown in that patent would not appear to be applicable to mobile homes having box beams as the underframe members, as opposed to the I-beams shown in that patent, since access would be impossible to the space beneath the mobile home intermediate the box members once the mobile home has been lowered onto the support surface.

In addition, the jacks used to raise and lower the mobile home must be provided in an excavated clearance space beneath the mobile home, further adding to the difficulties of installation, and creating drainage difficulties.

Another approach is described in U.S. Pat. No. 3,708,931 in which a very extensive concrete foundation is provided with a large well extending down into the ground with a service access cavity to in effect provide a "basement" for the mobile home. This very extensive reinforced concrete structure could, of course, be quite expensive, and to some extent defeating the purpose of the mobile home approach of providing low cost shelter units.

U.S. Pat. No. 3,830,024 discloses a plurality of piers with a telescoping mounting arrangement to allow leveling of the mobile home on the piers. The resulting height of the mobile home is still undesirably great. Additionally, the pier supports for the mobile home are not "laterally stablized" with respect to the earth, that is while the piers presumably would be emplaced at a depth in the ground which would provide adequate support against vertical movement of the piers due to the freezing and thawing of the earth, such piers are not restrained from lateral movement of its upper portion due to such freezing and thawing. Thus, if they were installed at a date much prior to the installation of the mobile home, and if freezing of the earth had taken place in the interim, the mounting structure could be misaligned by virtue of the vertical shifting of these piers, such as to prevent installation of the mobile home. Furthermore, if the pier structure were installed just prior to the installation of the mobile home, the resulting lateral movement of the piers would misposition the mobile home.

Many support arrangements utilized in the past are not applicable to frame beam spacings other than the standard 76 inches and thus are not universally applicable.

Accordingly, it is an object of the present invention to provide a foundation arrangement for such manufactured structures which provides a foundation at grade to support the mobile home structure so as to resist any lateral movements of the foundation resulting from movements of the earth at the surface and also adequately resists overturning forces produced by wind gusts.

It is another object of the present invention to provide such a foundation arrangement which supports the mobile home at a minimum ground clearance to reduce the wind induced overturning forces, and also improve the aesthetic appearance of the mobile home, and eliminates the need for extensive mobile home skirting.

It is yet another object of the present invention to provide such a foundation arrangement which allows the mobile home to be mounted to the foundation with relatively easy access to the undercarriage during such installation.

It is still a further object of the present invention to provide such a foundation arrangement in which the costs of preparing the foundation are kept to a minimum.

It is yet another object of the present invention to provide such a foundation arrangement and method of installation of the mobile home which does not require excavations for the jacks used to raise and lower the mobile home into position.

Another object of the present invention is to provide such a foundation arrangement having universal application.

Yet another object is to provide a foundation arrangement and installation procedure which allows removal of the running gear to reduce the cost of the installed mobile home.

SUMMARY OF THE INVENTION

These and other objects of the invention which will become apparent upon a reading of the following specifications and claims are provided by a plurality of telescoping supports or stanchions which are laterally stabilized to maintain the vertical alignment thereof resisting freeze-thaw or mud induced movements of the earth, and which are capable of collapsing to a position very close to the ground to provide the minimal ground clearance installation.

In the first embodiment the lateral stabilization is provided by a concrete pier for each telescoping stanchion which pier is formed by concrete poured into virgin earth excavation extending down to the frost line, all of which piers are laterally stabilized by virtue of being retained at their upper ends by being enclosed in an at grade concrete slab. The pier includes a casing encased therein to receive the upper portion of the telescoping stanchion to provide the minimum ground clearance in the lowered position.

In the second embodiment the vertical stability is provided by driving a foundation casing piling to a depth below the frost line or compaction so as to adequately vertically stabilize the casing and adequately support the weight of the mobile home. In this case the piling is augered out to a depth adequate to receive a casing sleeve to accommodate the telescoping stanchion arrangement beneath grade level to similarly provide the minimum ground clearance.

In another version of the invention, the telescoping stanchion support arrangements are all secured to a concrete slab structure to provide the vertical alignment of the telescoping stanchions.

In all of these embodiments, the telescoping stanchion is elevated to be secured to the mobile home underframe when the mobile home is elevated by virtue of a plurality of jacks above the grade surface to a height adequate for access. After securement, the mobile home is lowered onto the minimum ground clearance position with the stanchions telescoping into the casings to accommodate this movement.

A procedure for raising and lowering the mobile home is also provided which eliminates the need for excavations for the jacks, while allowing the mobile home to be lowered to the minimum ground clearance position.

BRIEF DESCRIPTION OF THE DRAWINGS

FIG. 1 is a front elevational view of a mobile home installation shown in partial section;

FIG. 2 is an enlarged plan view of a mounting plate used in the foundation assembly as shown in FIG. 1;

FIG. 2A is a plan view of a modification of the mounting plate used in the foundation assembly shown in FIG. 1;

FIG. 3 is a fragmentary endwise view of a mobile home installed on an alternate casing embodiment of the foundation arrangement, shown in partial section;

FIG. 4 is a view in partial section of yet another embodiment of the foundation arrangement according to the present invention;

DETAILED DESCRIPTION

Figure 19:
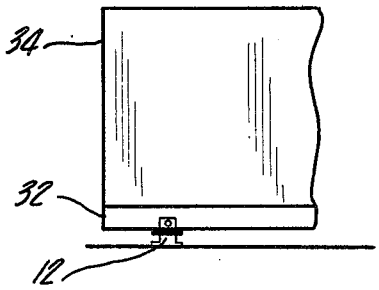
FIGS. 12 through 19 are fragmentary views of the mobile home, shown in FIG. 11, at various stages in the raising and lowering of the mobile home.

In the following detailed description certain specific terminology will be utilized for the sake of clarity and particular embodiments described in accordance with the requirements of 35 USC 112, but it is to be understood that the same is not intended to be limiting and should not be so construed, inasmuch as the invention is capable of many forms and variations within the scope of the appended claims.

In accordance with the foundation according to the present invention and the method of the present invention a plurality of telescoping stanchions are provided which are adapted to be raised to be secured to the mobile home underframe in an elevated position, after which securement the mobile home is then lowered into a position with a minimum ground clearance. The arrangement for achoring these telescoping stanchions takes various forms according to the different embodiments of the present invention.

The first embodiment is shown in FIG. 1, in which a telescoping stanchion 12 comprised of a length of steel pipe is received within a casing 14 which may be provided by steel tubing encased within a poured concrete pier 16. As shown, the casing 14 has an inside diameter sized to provide a slidable fit with the outside diameter of the stanchion 12. The concrete pier 16 would be provided by pouring concrete into a bore hole excavated into the surface of the ground, to a depth equal to the frost line, as indicated. The casing 14 extends downwardly to a depth sufficient to provide an axial clearance space for receiving the telescoping stanchion 12, an end cap 15 is being provided to exclude wet concrete. For typical applications, the stanchion 12 would be dimensioned at approximately 26–32 inches in length and the casing 14 would, therefore, be dimensioned so as to provide end clearance in the full down position.

The concrete pier 16 is laterally stabilized in its upper position by virtue of being encased within a concrete slab 18, 4 inches or more in thickness, poured over a depth of compacted fill sand and which acts to provide the lateral stabilization of the upper portion of the concrete pier 16 with respect to the ground. While the emplacement of the concrete pier 16 itself to the depth of the frost line provides adequate vertical support for the stanchion 12 and the mobile home mounted thereto, the earth surrounding the concrete pier 16 does not provide substantial lateral support in that the concrete pier 16 and the casing 14 and telescoping stanchion 12 may be skewed during freeze-thaw conditions if some means for providing lateral stabilization is not provided. It has been found that the slab 18 in conjunction with the concrete pier 16 poured in place provides a support for the telescoping stanchions 12 which is stabilized both as to vertical and lateral movements, so that all of the telescoping stanchions 12 are maintained in substantially vertical alignment.

This maintenance of the vertical alignment of the telescoping stanchion 12 is, of course, critical since the resulting skewing which would take place if the supports were not laterally stabilized would either prevent alignment of the stanchion support with the beam during the installation process or interfere with lowering of the mobile home. If this skewing took place after installation, it could induce distorting stresses on the underframe of the mobile home or movement thereof out of level.

The telescoping stanchion 12 includes an upper bracket plate 20, welded to the terminal end of the stanchion 12, with a second matching mounting plate 22, bolted thereby by a plurality of bolts 24, passing through elongated slots 26 in the mounting plate 20, and also through holes 28, formed in the mounting plate 22 as shown in FIG. 4.

Mounting plate 22 has welded to its upper surface thereof, a U-shaped bracket 30 which is dimensioned to receive the underframe member 32, which is secured to the mobile home structure 34, to provide the underframe structure. Typically, two such underframe members are utilized, as shown in FIG. 1.

The underframe member 32 is secured within the bracket 30, as shown, by means of a nut and bolt arrangement 34, passing through the sides of the bracket 30 and through the beam 32. The slots 26 allow for misalignments between the stanchions 12 and the underframe beam 32. FIG. 2A shows an extended version of the mounting plate 20 allowing for larger slots 26 in the event grosser adjustments are anticipated.

A series of through holes 33 are drilled through the stanchion 12 to accommodate a nut and bolt assembly 35 which will act in engagement with the upper edge of the casing pipe 14 to provide a positive down stop upon lowering of the mobile home, as will be described hereinafter. Resistance to uplift is provided by the weight of the mobile home, and also by wedging action between the stanchions 12 and the casings 14 caused by lateral wind thrust loads. The casings 14 may also be positioned above the level of the slab 18 or grade and provided with through holes to provide a positive lock.

In FIG. 3 an alternate embodiment of the support for the telescoping stanchion assembly 10 is provided. In this case a foundation casing 36 is provided which is first driven into the ground by a pile driver, or other suitable means, to a depth which will provide substantial lateral support for the foundation casing 36. This depth is generally referred to in civil engineering terms as the "compaction depth" and typically extends for some distance below frost line, but which distance depends on the local soil conditions. The earth is then augered out of the interior of the foundation casing 36 to a depth adequate to receive the casing 14 which is then positioned within the interior of the foundation 36 and a ring of concrete 38 is poured into the space therebetween. In this instance a slab at grade is not required to provide surface stability or lateral stability for the telescoping stanchion assembly 12 by virtue of the lateral stability provided by the depth to which the foundation casing 36 is driven.

Alternatively, under proper soil conditions, the casings 14 may be directly driven into the ground, eliminating the need for the separate foundation casings 36.

Finally, in FIG. 4 an arrangement is shown which is adaptable to those situations wherein existing piers and/or concrete slabs have been provided. In this instance, a mounting plate assembly 40 is utilized which includes a base plate 42 which is secured to the slab 44 by virtue of masonry anchors 46. The base plate assembly 40 also includes an upright casing section 48 welded to the base plate 42 and adapted to receive a telescoping stanchion 50, having a mounting plate 52 welded to its upper end, with a bracket plate 22, as in the other embodiments, bolted to the mounting plate 52 with a series of nuts and bolts 28 having a central U-bracket 30 welded thereto. This U-bracket is similarly locked to the mobile home beam 32 by virtue of the nut and bolt assembly 34 passing through beam 32 and the bracket 30.

In this arrangement the depth of the telescoping action is less, increasing the ground clearance required and also necessitating the bolting of the casing pipe 48 to the stanchion 50, since the wedging action present in the above embodiments therebetween is less by virtue of the reduction in the length of overlap. In this instance a bolt 35 is used as the stop in the elevated position and nests into a groove 51 formed in the upper edge of the casing 48. In addition the casing 48 is provided with a pair of through holes 54 which are adapted to mate with the holes 33 in the stanchion pipe 50 in various positions relative to each other, and the bolt 35 passed into the hole to lock the telescoping stanchion 50 in the down position.

Figure 4A:
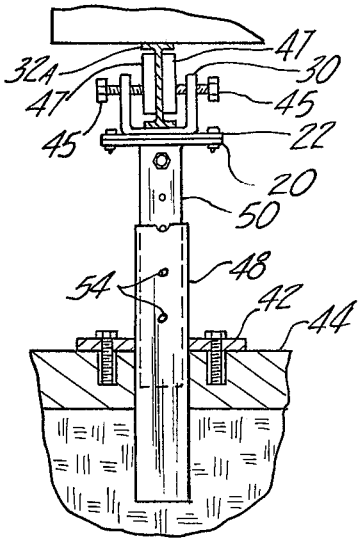
FIG. 4A is a view in partial section of an alternate embodiment of the embodiment shown in FIG. 4.

FIG. 4A shows an alternate form of securing the U-bracket 30 to the underframe member, here shown as I-beam 32A, where the drilling of holes is to be avoided. This involves a pair of clamping elements 47 disposed between the U-bracket 30 and the central web of the I-beam 32A. Bolts 45 engaging the clamping elements force the clamping elements 47 into secure engagement with the I-beam 30A.

FIG. 4A also depicts an alternate form of the foundation arrangement, shown in FIG. 4, in which the casing 48 extends downwardly through a hole cut in the slab 44 and a coring through the earth below, allowing additional elevational adjustment, and improved lateral resistance. The stanchion 50 can thus be lengthened, as shown.

According to the procedure of the present invention installation of the mobile home 34, the mobile home 34 must be first elevated to remove the axles, tow bar, and wheels and secure the stanchions 12 to the underframe, then lowered to the full down position, as will be described hereinafter in more detail. The lowering is to be done by means of jacks engaging the underframe of the structure, as opposed to an overhead derrick arrangement, and difficulties would be encountered since the jack must operate within the clearance space existing between the bottom of the underframe and the floor structure, since the height of the floor above the surface of the slab or pier would, of course, not be adequate to accommodate a jack having sufficient height to lower the mobile home through the entire extent of movement required to carry out the installation procedure. This could be avoided by operating the jacks in excavations, but such excavations are sought to be avoided by the procedure according to the present invention.

This being the case, a stepped raising and lowering of the mobile home is carried out in which hydraulic jacks are provided which engage the mobile home frame simultaneously in several different modes during the raising and lowering process.

Figure 5:
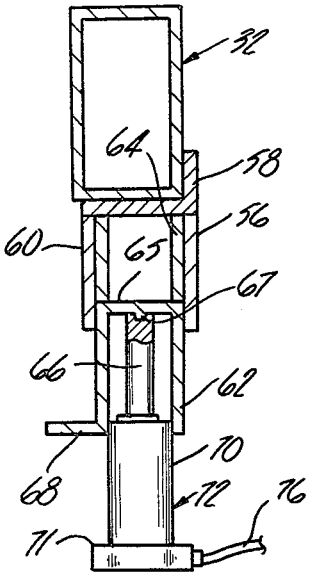
FIG. 5 is a fragmentary view of a representative jacking arrangement for raising and lowering the mobile home during installation of the mobile home on the foundation arrangement.

FIG. 5 depicts a jack arrangement 72 which is suitable for carrying out this procedure. This arrangement includes an upper extender assembly 56, having an angle bracket 58, welded to the upper end thereof. The extender assembly 56 includes an outer sleeve 60 which has an inside diameter such as to be received over a cylinder jacket 62, positioned thereon by means of a liner pipe 64, welded to the inside of the sleeve 60, so as to abut the upper surface of an end plate 65, forming part of the jacket 62. The cylinder operating rod 66 is secured to the end plate 65 by means of a flange or head 67 fitting into the center of the operating rod 66. Welded to the jacket 62 is a bracket plate 68 which is adapted to engage the edge of the underframe beam 32 in its final mode as will be described. The jacket 62 is received over the housing 70 of the jack, while the housing 70 terminates in the base housing 71 which is typically provided with inlet and outlet openings receiving fittings 74 to connect the hydraulic lines 76 thereto, thus to pressurize the jacks 72 for stroking of the operating rod 66.

Details of the jacks 72 are not here included, inasmuch as they may be conventional commercially available devices.

Figure 11:
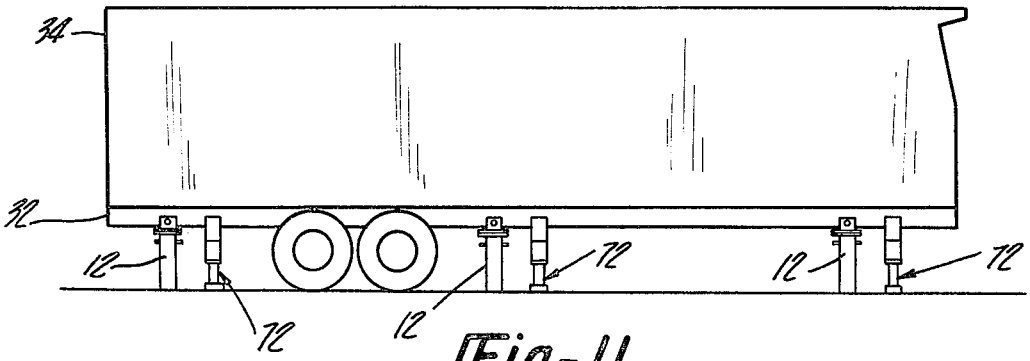
FIG. 11 is a side elevational view of the mobile home placed in position over the telescoping stanchion support assemblies prior to being elevated.

The mobile home 34 is first positioned over the stanchions 12, as shown in FIG. 11, with the stanchions being raised and bolted to the beams 32.

Figure 6:
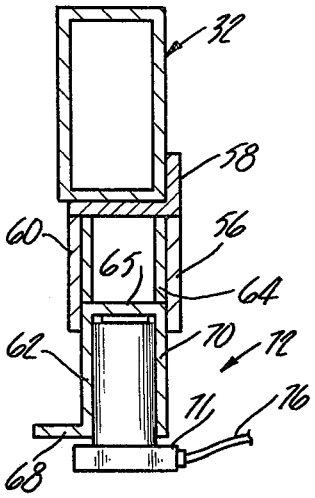
FIGS. 6 through 10 are fragmentary views of the engagement of the jacks, shown in FIG. 5, during various lowering steps showing the various engagement positions of each jack with the mobile home underframe.
Figure 12:
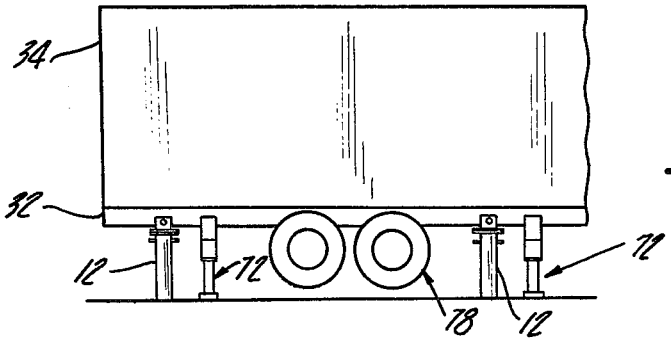
Figure 13:
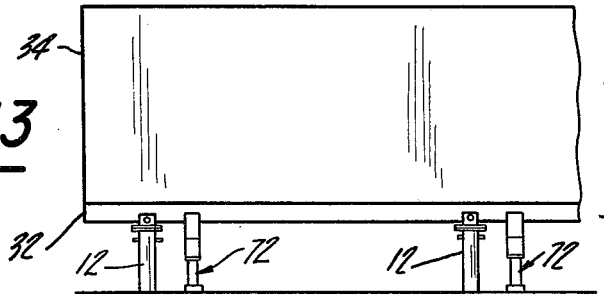
Figure 14:
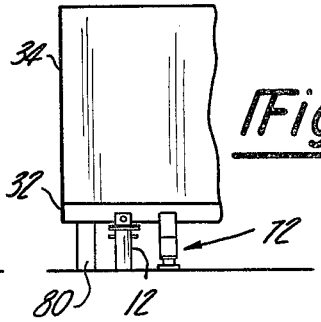

Referring to FIG. 5, the jacks 72 are all positioned with the extender 56 placed over the jacket 62 with the angle bracket 58 engaged with the beam 32. The jacks 72 are then all operated to raise the mobile home sufficiently to unload the mobile home wheels 78 at which time the stanchions 12 are lifted since they were previously locked to the beams 32 thereby raised with the mobile home underframe beams 32, as shown in FIG. 12. At this point the mobile home wheels 78 and other running gear are removed, as shown in FIG. 13. The jacks 72 are then operated to lower the mobile home onto a first set of retrievers 80, as shown in FIG. 14, which are of a height approximately equal to the original height at which the mobile home 34 was supported above the slab 18 surface. The jacks 72 are then lowered to a point allowing them to be withdrawn, as shown in FIG. 6, and the extension assemblies 56 them all removed and the jacks 72 repositioned beneath the beam 32 in the position.

Figure 7:
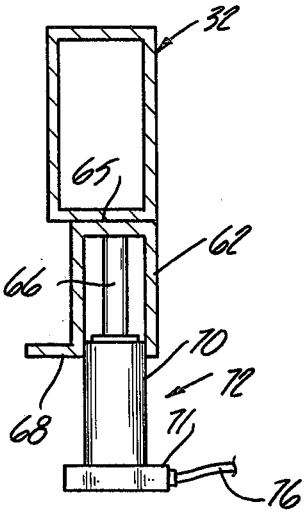
Figure 8:
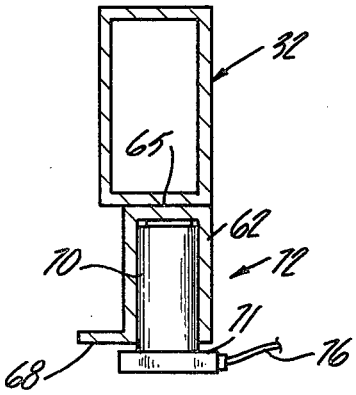
Figure 9:
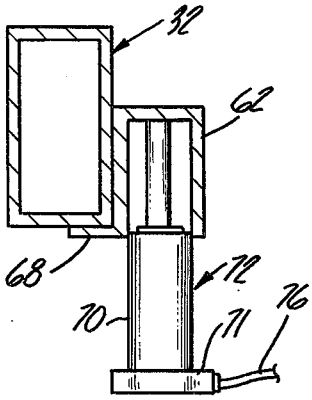
Figure 10:
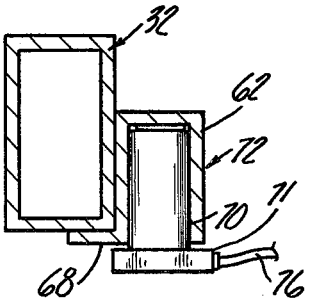
Figure 15:
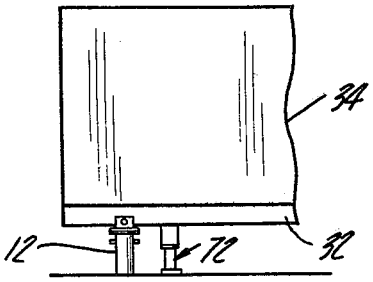
Figure 16:
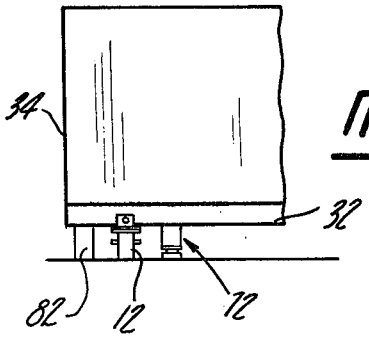
Figure 17:
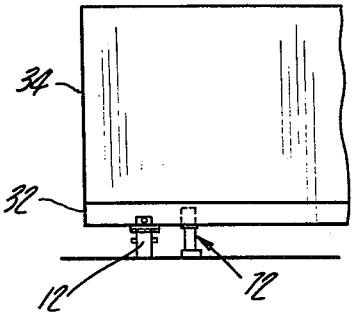
Figure 18:
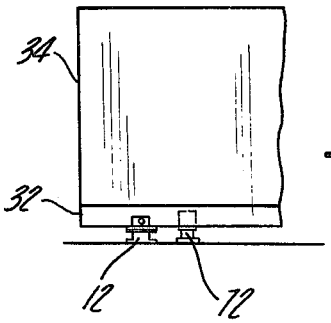

The jacks 72 are then again operated, as shown in FIGS. 7 and 15, to elevate the box beams 32 and mobile home 34 sufficiently to unload the first set of retrievers 80 to be replaced with a second shorter set of retrievers 82 with the jacks 72 then being operated to lower the mobile home 34 onto the second set of retrievers 82, as shown in FIG. 16. The jacks 72 are then lowered further to allow removal thereof, and repositioning with respect to the beams 32 with the bracket 68 raised into position to engage the beams 32, with the jack extenders angle brackets, as shown in FIGS. 9 and 17. The jacks 72 are again elevated to release the second retriever set 82 to allow their removal and thence, the jacks 72 are simultaneously operated to lower the mobile home to the point where the bolt assemblies 35 arrest further lowering movement, such that the jacks 72 may be removed as shown in FIG. 19.

This procedure allows a jack operating with a relatively limited overhead clearance area to lower the mobile home 34 to a very minimal ground clearance, as can be appreciated by this description.

In this final position the stanchion 12 will be wedged to securely retain the mobile home on the foundation with attachment to brackets 30 securely preventing any overturning of the mobile home as a result of gusting winds with the relatively low profile also aiding toward this end.

Figure 20:
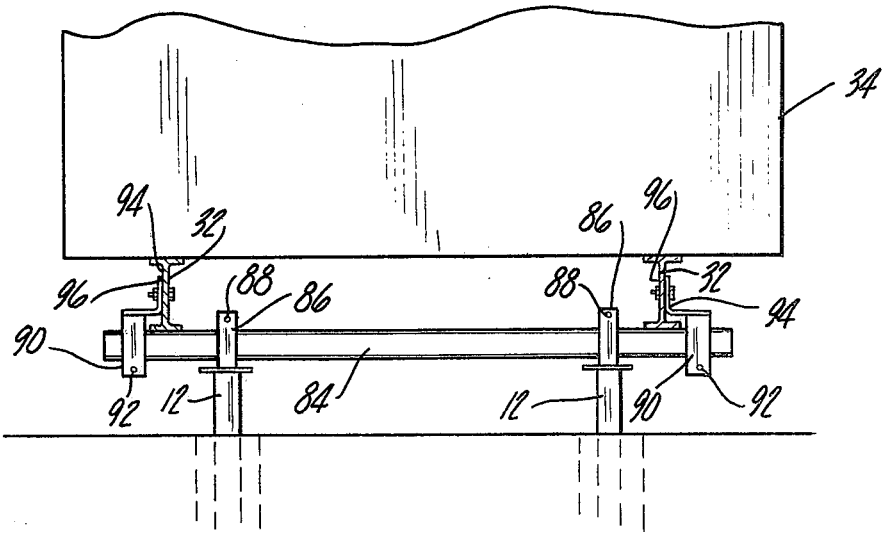
FIG. 20 is an elevational view in partial section of a foundation arrangement according to the present invention showing a variation in the means attaching the stanchions to the mobile home underframe.

Referring to FIG. 20, an alternate approach is shown for securing the stanchion 12 to the mobile home underframe in those instances where an installation must be adapted to a non-standard beam spacing, i.e. 96 inches rather 76 inches or to "double wide" units. In this instance a cross bar 84 which may be provided by an I-beam is secured to a U-shaped bracket 86 welded to the upper end of aligned pairs of stanchions 12, by means of bolts 88 passing through the upper legs of the U-shaped brackets 84. Similarly fastened to the crossbar 84 is a pair of inverted U-brackets 90 fastened thereto by bolts 92. A bracket 94 is welded to each U-bracket 90 and bolted at 96 to the frame beams 32 after being located on the cross bar 84 at the appropriate location.

From this description it can be appreciated that the objects of the present invention have been accomplished, since the securement of the telescoping stanchions is carried out while the mobile home is in an elevated position, allowing easy access to the underframe for carrying out the securing, locking, and installation of the telescoping stanchions to the mobile home underframe, this telescoping action then allowing the lowering of the mobile home to a very minimal ground clearance. At the same time the individual telescoping stanchion assemblies are maintained in substantial vertical alignment by virtue of the lateral stabilization of these assemblies provided by the respective embodiments of the particular arrangements wherein the stanchions are supported in the earth to in effect provide a foundation at grade, as this term has been referred to herein.

In addition, a procedure and arrangement has been provided for allowing elevating of the mobile home and lowering thereof by jacks which does not require the use of or the excavation beneath the level of the mobile home, even though the mobile home is lowered to a position where a minimum of ground clearance is provided. This approach also allows the advance preparation of installation sites at relatively low costs, providing for the permanent stable support foundation for the mobile home. All this has been provided with this relatively low-cost structure with a minimum of labor required, so that the cost of the same is quite modest and in keeping with the marketing structure of mobile homes.

While a mobile home application has been described above, this concept is of course applicable to modular housing by upgrading the structural load specification of the various parts in accordance with the increased weight of the unit.

The embodiments of the invention in which an exclusive property or privilege is claimed are defined as follows:

1. A foundation arrangement for application to structures having an underframe support, the foundation including: a plurality of telescoping stanchions; means for connecting an upper end of each of said telescoping stanchions to said structure underframe, said means comprising a bracket plate, a U-shaped bracket secured to said bracket plate, a second mounting plate; means adjustably mounting said bracket plate to said second mounting plate; means connecting said second mounting plate to said stanchion member, whereby said U-shaped bracket may be laterally adjusted with respect to said stanchion to compensate for mispositioning of said underframe and said telescoping stanchion; a plurality of casing means for receiving and guiding each of said telescoping stanchions, said telescoping stanchions being freely slideable in said casings, and said casing means accommodating vertical elevational movement of said telescoping stanchion during installation procedures; foundation means for supporting each of said casing means with respect to the ground; lateral stabilization means enabling each of said casing means to receive a respective one of said plurality of telescoping stanchion means and to maintain vertical alignment thereof, whereby said telescoping stanchions may be secured to said structure underframe in an elevated position and said underframe subsequently lowered by sliding movement of said stanchions in said casings to a lower position to thereby minimize the ground clearance of said underframe above the ground.

2. A method of mounting a structure such as a mobile home having an underframe to provide a foundation therefore resisting movements induced by earth movement, the method comprising the steps of: providing a foundation ground support for a plurality of casings disposed in a pattern and in vertical alignment with each other; placing in each of the casings a stanchion, each said casing being adapted to accommodate freely slideable telescoping movement of said telescoping stanchions; positioning said structure over said plurality of stanchions; raising said stanchion by virtue of said telescoping movement into position with respect to said underframe structure; attaching each of said stanchions at an upper end thereof to said underframe; and, lowering said underframe structure to position of a lesser ground clearance than in said elevated position.

3. The method according to claim 2 further including the step of elevating said underframe structure after positioning said underframe structure over said plurality of stanchions.

4. The method according to claim 3 wherein said elevation of said underframe structure is carried out by means of a plurality of vertically operable jacks and wherein in said step of elevating said underframe structure a removable extension member is positioned on a vertically movable element of each of said jacks and wherein said step of lowering said underframe structure includes a positioning a plurality of retrievers beneath said underframe structure, and also includes the steps of lowering said underframe structure onto said retrievers, removing said removable extension members from said jacks, reengaging said jacks with said underframe structure, removing said plurality of retriever stops and subsequently again lowering said underframe structure by means of said jacks, whereby said jacks vertical height necessary for lowering said underframe structure is reduced.

5. The method according to claim 4 wherein each of said jacks has a plurality of engagement surfaces at different vertical heights on said jacks, and wherein in said step of lowering said underframe structure subsequent to said removal of said retrievers, said jacks are lowered to lower said underframe structure onto a second set or retrievers of a lower height than said first set of retrievers.

* * * * *